US010633809B2

(12) United States Patent
Petty et al.

(10) Patent No.: US 10,633,809 B2
(45) Date of Patent: Apr. 28, 2020

(54) ADJUSTABLE-WIDTH MODULAR BROOM ASSEMBLY FOR SWEEPING MACHINE

(71) Applicant: Roadtec, Inc., Chattanooga, TN (US)

(72) Inventors: Chris Petty, Decatur, TN (US); David Moyer, Lafayette, GA (US)

(73) Assignee: Roadtec, Inc., Chattanooga, TN (US)

( * ) Notice: Subject to any disclaimer, the term of this patent is extended or adjusted under 35 U.S.C. 154(b) by 21 days.

(21) Appl. No.: 16/181,589

(22) Filed: Nov. 6, 2018

(65) Prior Publication Data

US 2019/0136472 A1 May 9, 2019

Related U.S. Application Data

(60) Provisional application No. 62/582,667, filed on Nov. 7, 2017.

(51) Int. Cl.
*E01H 1/05* (2006.01)
*E01H 1/04* (2006.01)

(52) U.S. Cl.
CPC ..... *E01H 1/056* (2013.01); *E01H 1/045* (2013.01)

(58) Field of Classification Search
CPC ..... E01H 1/056; E01H 1/045
See application file for complete search history.

(56) References Cited

U.S. PATENT DOCUMENTS 6,006,390 A * 12/1999 Bischel ..... E01H 1/056 15/340.3
6,088,865 A * 7/2000 Truan ..... E01H 1/02 15/190
6,195,836 B1 * 3/2001 Vanderlinden ..... A47L 11/24 15/340.3
6,672,675 B1 1/2004 Swain
8,914,933 B1 12/2014 Petty et al.
10,329,724 B2 6/2019 Petty et al.
2004/0045585 A1 * 3/2004 Wilmo ..... E01H 1/042 134/6
2017/0145645 A1 5/2017 Petty et al.
2017/0145646 A1 5/2017 Petty et al.
2017/0145647 A1 * 5/2017 Petty ..... E01H 1/042

FOREIGN PATENT DOCUMENTS

DE 297 19 508 U1 2/1998

OTHER PUBLICATIONS

Office Action of counterpart Canadian Application No. 3,023,309 dated Oct. 22, 2019.

* cited by examiner

*Primary Examiner* — Dung Van Nguyen
(74) *Attorney, Agent, or Firm* — Chambliss, Bahner & Stophel, P.C.

(57) ABSTRACT

A vehicular sweeping machine that is adapted to rotate a broom about a substantially horizontal axis to sweep material into a broom conveyor of fixed width is provided with a modular broom assembly that can accommodate a broom of a first length and a broom of a second length that is longer than the first length. The modular broom assembly includes a primary broom enclosure that is adapted to accommodate the broom of the first length, and an extension assembly that includes broom extension components which are adapted to be installed on the primary broom enclosure to increase the width of the primary broom enclosure to accommodate the broom of the second length, and to direct material swept by the broom of the second length into the broom conveyor.

13 Claims, 11 Drawing Sheets

ADJUSTABLE-WIDTH MODULAR BROOM ASSEMBLY FOR SWEEPING MACHINE

CROSS-REFERENCE TO RELATED APPLICATION

This application claims the benefit of U.S. Provisional Patent Application No. 62/582,667 which was filed on Nov. 7, 2017.

FIELD OF THE INVENTION

The invention relates generally to a vehicular sweeping machine that may be used in sweeping streets, parking lots and other large surfaces. More particularly, the invention relates to a sweeping apparatus for a vehicular sweeping machine which includes a broom assembly that may be modified to change the width of its sweeping path in order to accommodate brooms of different sizes.

BACKGROUND AND DESCRIPTION OF THE PRIOR ART

Roadway repair is often accomplished by overlaying the existing pavement (whether of concrete or asphalt paving material) with a new layer (often called a leveling course) of concrete or asphalt paving material. Without prior surface treatment, however, this method of repair generally results in the application of insufficient quantities of paving material in the rutted, potholed or otherwise damaged areas, because the overlay will be applied at the same rate per unit of roadway width in damaged areas (which have a greater depth to be filled across the width) as in the undamaged areas. The resulting reduced thickness in the overlay of the previously damaged areas will lead to renewed rutting or other wear damage in the new pavement in relatively short order. However, by milling the surface of the damaged pavement to a uniform surface elevation below the level of the damage, the addition of a new pavement overlay will produce a road surface having a consistent elevation across the entire width of the roadway. This repaving technique can be used to return the elevation of a damaged roadway to its original pre-damaged elevation, whereas the placement of a leveling course atop damaged but un-milled pavement will tend to raise the surface of the roadway or some portion thereof above its original elevation. Roadway repair without milling can require the raising of road shoulders, guardrails and manhole covers and the adjustment of overpass clearances, all of which is unnecessary if a proper milling technique is employed. A use of milling prior to repaving can also permit ready establishment of the proper road grade and slope, and thereby avoid drainage and safety problems. Furthermore, milling typically provides a rough surface that readily accepts and bonds with the new asphalt or other pavement overlay. Finally, milling can provide raw material that can be reclaimed for use in the production of new paving materials.

A milling machine typically comprises a wheel-driven or track-driven vehicle that includes a milling drum having a plurality of cutting teeth around its periphery. The milling drum is mounted for rotation about a substantially-horizontal axis within a drum housing on the frame of the machine. Steerable wheel-drive or track-drive assemblies operated by hydraulic motors are provided to drive the machine in a milling direction and to steer it along a desired milling path. The drive assemblies are attached to lifting columns that include internal linear actuators which can be activated to raise and lower the frame of the machine with respect to the roadway surface. Milling machines are provided in various sizes so as to be able to produce a cut on the roadway ranging in width from about 6 feet to about 13.5 feet. Generally, the milling machine also includes a conveyor system that is designed to carry the majority of the milled material that has been cut from the roadway by the rotating drum to a location in front of, to the rear of, or beside the machine for deposit into a truck for removal from the milling site. Sweeping machines are frequently required, however, to follow a milling machine in order to remove any milled material left behind by the milling machine prior to resurfacing.

Conventional sweeping machines typically employ a broom assembly comprising one or more brooms mounted for rotation about horizontal or vertical axes. Some conventional machines may operate by pushing the swept material to one side of the machine where it may be collected by a separate collecting device. Other conventional machines include a broom assembly and an integral collecting assembly for collecting material swept by the broom or brooms. Such integral collecting assemblies may comprise vacuum systems for capturing the material swept by the brooms or discharge conveyors for transporting such material to a hopper or an adjacent truck.

Some conventional sweeping machines include broom assemblies which employ permanent brooms, while others employ replaceable brooms. Typically, a replaceable broom comprises a cylindrical broom tube of steel or other durable material having a plurality of bristles disposed around its outer periphery. Conventional sweeping machines that employ replaceable brooms typically hold the broom tube inside the machine with a pair of drive hubs, one on each end. These hubs are typically mounted in bearings that are bolted or otherwise attached to arms on the sweeping assembly that may be raised or lowered to move the broom into and out of contact with the roadway. Because of the way that conventional broom assemblies are mounted to the sweeping machine, the width of the broom assembly (i.e., the dimension of the broom assembly that is transverse to the forward sweeping direction, as hereinafter defined) cannot be adjusted.

Consequently, when sweeping the milled portion of a roadway that is wider than the fixed width of the broom assembly, a conventional sweeping machine must make multiple passes across the milled portion of the roadway to completely sweep the road surface. It would be desirable if an assembly of components could be provided by which the width of the sweeping path of the broom assembly of a vehicular sweeping machine could be readily and easily changed to allow the machine to accommodate brooms of different lengths. Such a modification would allow a single machine to be used for sweeping of roadways in a single pass, regardless of the width of the milled portion of the roadway.

ADVANTAGES OF A PREFERRED EMBODIMENT OF THE INVENTION

Among the advantages of a preferred embodiment of the invention is the provision of an assembly of components for easily modifying the width of the broom assembly of a vehicular sweeping machine to accommodate brooms of different lengths. Such a modification allows a single machine to be used for sweeping the milled portion of roadways having different widths in a single pass. Other advantages and features of this invention will become apparent from an examination of the drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The terms "operatively connected" and "operatively attached" describe such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The terms "lower", "bottom", "below" and similar terms, when used in reference to a relative position or direction on or with respect to a vehicular sweeping machine, or an assembly, component or portion thereof, refer to a relative position or direction that is nearer the roadway on which the vehicular sweeping machine is placed for operation.

The terms "upper", "top", "above" and similar terms, when used in reference to a relative position or direction on or with respect to a vehicular sweeping machine or an assembly, component or portion thereof, refer to a relative position or direction that is farther away from the roadway on which the vehicular sweeping machine is placed for operation.

The term "forward sweeping direction" is the direction that the operator of the vehicular sweeping machine faces when he is seated in the normal position for the operator of the vehicular sweeping machine. The "forward sweeping direction" is the direction that the vehicular sweeping machine typically moves in sweeping a roadway.

The term "in front of" and similar terms refer to an assembly, component or portion of a vehicular sweeping machine that is in the forward sweeping direction with respect to a reference point, assembly, component or portion of the vehicular sweeping machine.

The term "behind" and similar terms refer to an assembly, component or portion of a vehicular sweeping machine that is in the direction opposite the forward sweeping direction with respect to a reference point, assembly, component or portion of the vehicular sweeping machine.

The term "left", as used herein to describe a direction or relative position of a vehicular sweeping machine or an assembly, component or portion of such a sweeping machine, refers to a position or orientation towards the left, from the perspective of the operator who is driving the machine in the forward sweeping direction.

The term "right", as used herein to describe a direction or relative position of a vehicular sweeping machine or an assembly, component or portion of such a sweeping machine, refers to a position or orientation towards the right, from the perspective of the operator who is driving the machine in the forward sweeping direction.

The term "linear actuator" refers to an electric, pneumatic, hydraulic, electro-hydraulic or mechanical device that generates force which is directed in a straight line. Common examples of "linear actuators" are hydraulic and pneumatic actuators which include a cylinder, a piston within the cylinder, and a rod attached to the piston. By increasing the pressure within the cylinder on one side of the piston (over that on the opposite side of the piston), the rod will extend from the cylinder or retract into the cylinder.

SUMMARY OF THE INVENTION

The invention comprises a modular broom assembly for a vehicular sweeping machine that is adapted to rotate a broom about a substantially horizontal axis in order to sweep material into a broom conveyor of fixed width. The modular broom assembly may be modified to change its width so as to accommodate brooms of different lengths. The modular broom assembly includes a primary broom enclosure comprising a top plate and components of an outer moldboard. The primary broom enclosure also includes a pair of end gates and at least one broom enclosure extension assembly that may be removably attached to the primary broom enclosure. The broom enclosure extension assembly is adapted to accommodate a broom than is longer than one sized for the primary broom enclosure. The broom enclosure extension assembly includes an extension end gate transition plate that is configured to direct material swept by the longer broom into the broom conveyor.

In a preferred embodiment of the invention, a support tube assembly is attached to the front side of the outer moldboard, and the extension assembly includes an extension tube having a length that is compatible with the enclosure extension. The primary broom enclosure may be extended on one or both sides, and multiple extension components of various sizes may be provided to facilitate the assembly of broom enclosures of various widths which are adapted to accommodate brooms of various lengths.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter described herein, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiment of the invention is illustrated in the accompanying drawings, in which like reference numerals represent like parts throughout, and wherein.

DESCRIPTION OF THE PREFERRED EMBODIMENT OF THE INVENTION

Figure 1:
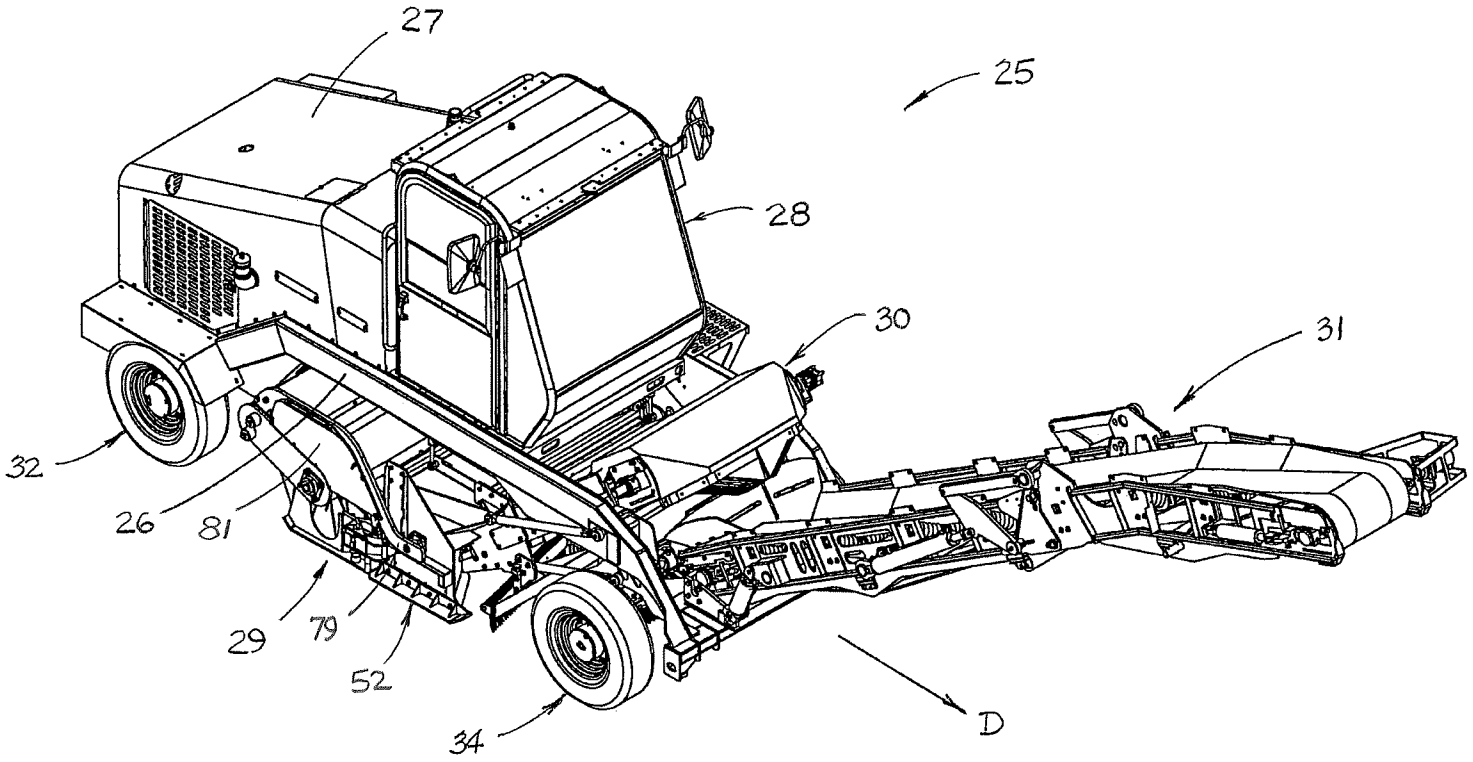
FIG. 1 is a right side perspective view of a vehicular sweeping machine that may be equipped with a preferred embodiment of the invention.
Figure 2:
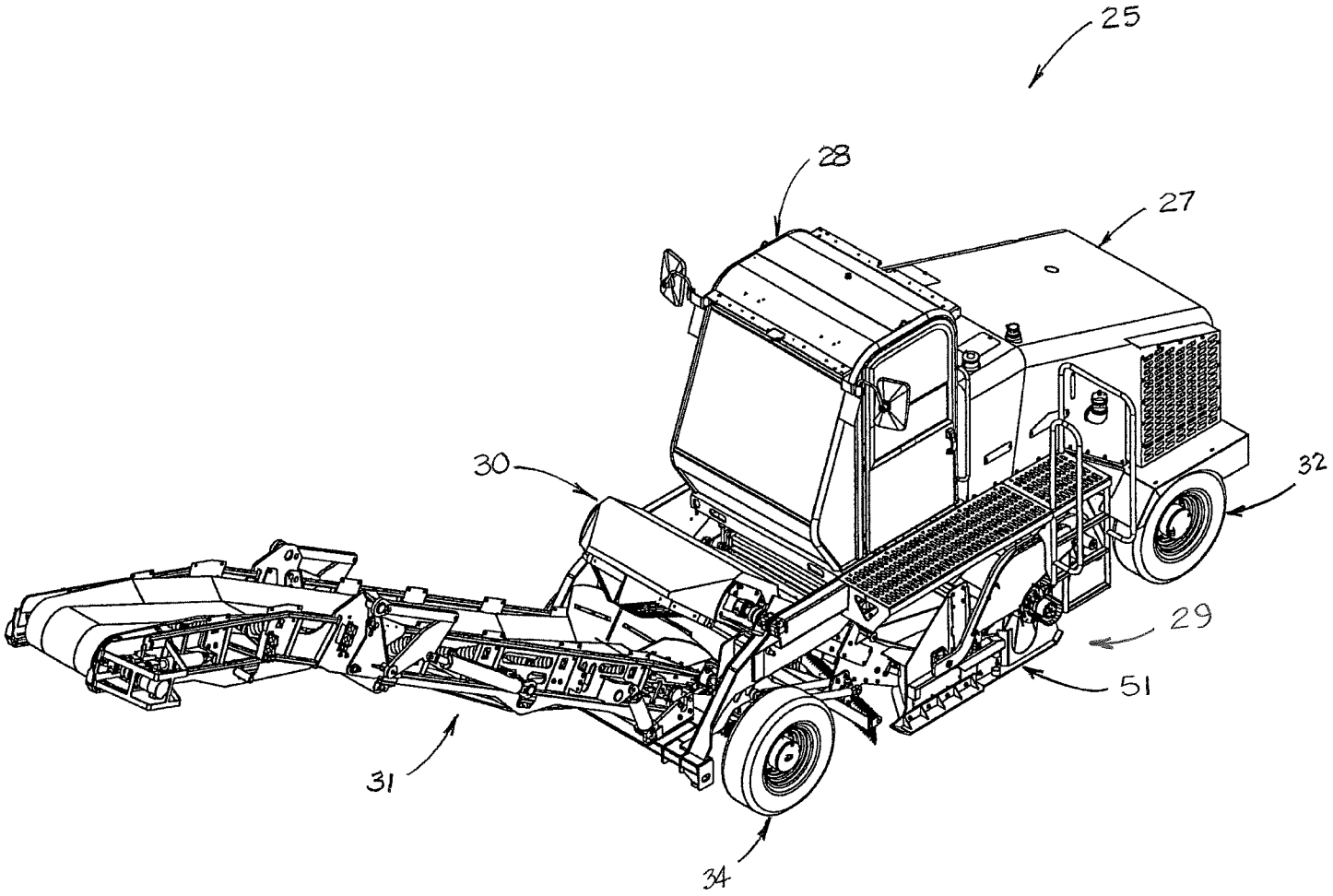
FIG. 2 is a left side perspective view of the vehicular sweeping machine illustrated in FIG. 1.
Figure 3:
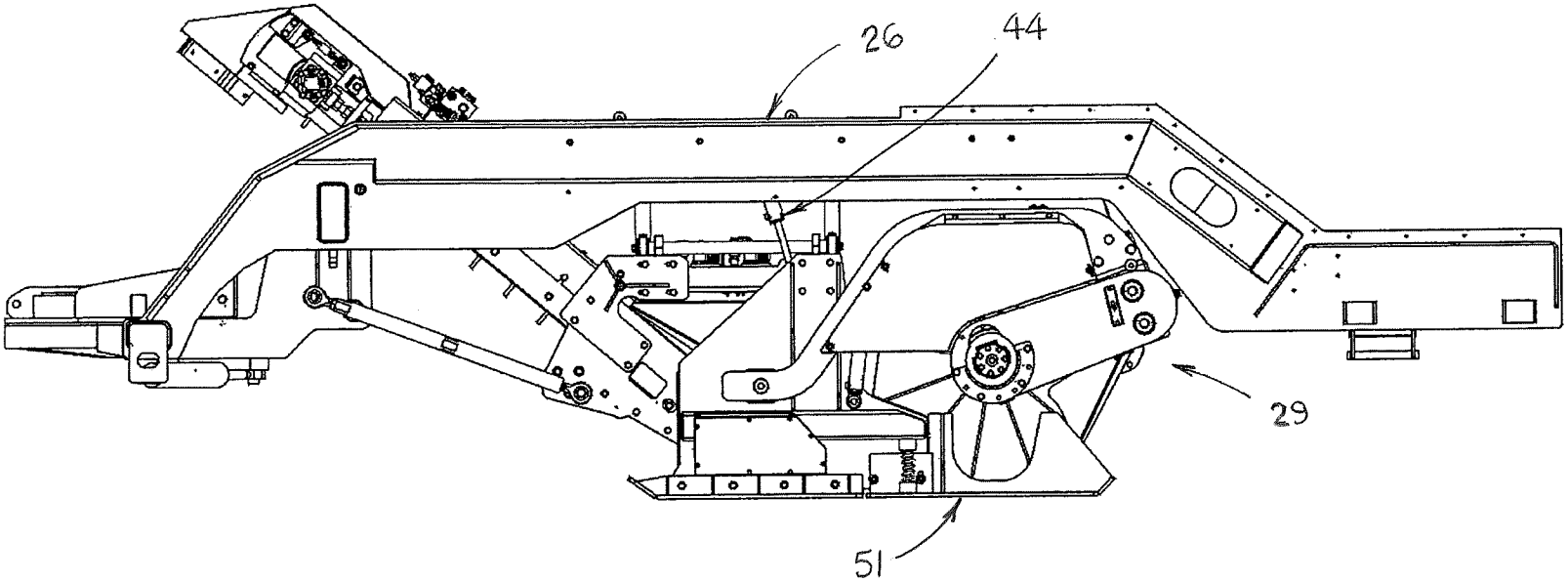
FIG. 3 is a left side view of a portion of the vehicular sweeping machine that is shown in FIGS. 1 and 2, illustrating the attachment of the broom assembly to the frame of the machine.
Figure 4:
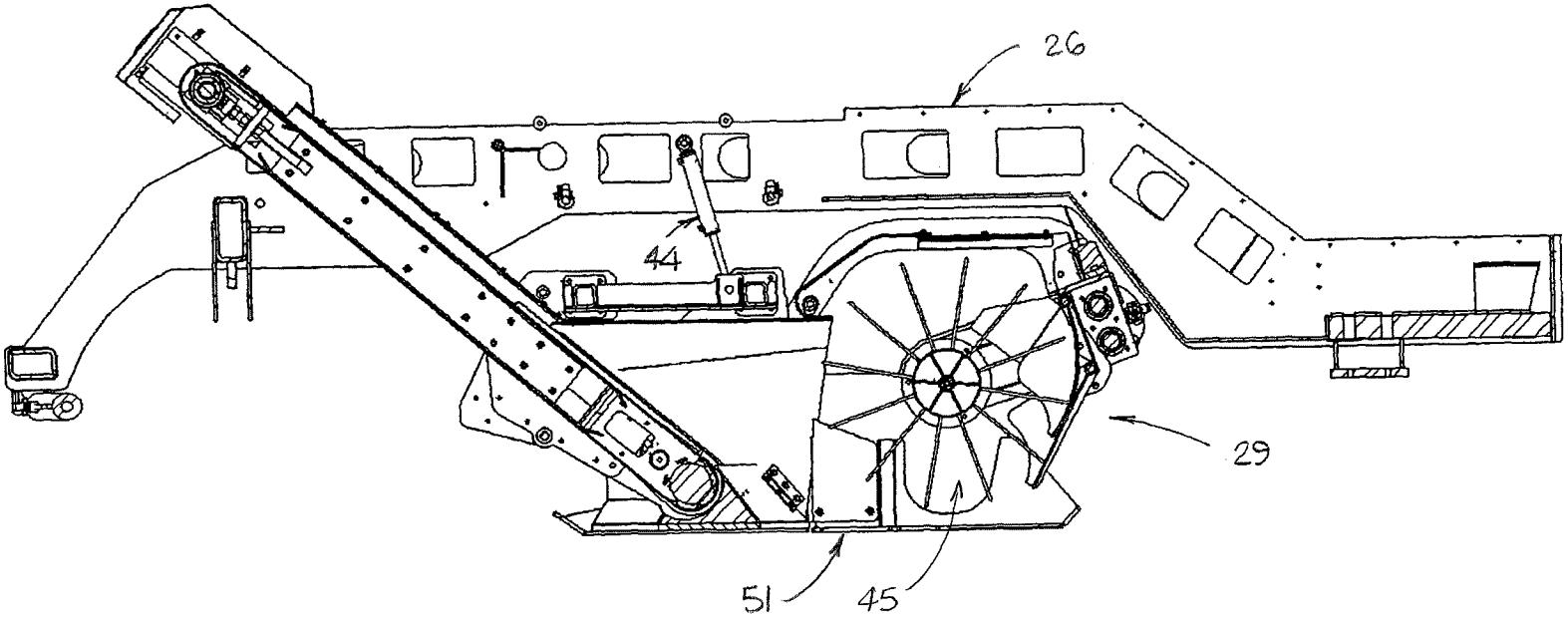
FIG. 4 is a left side view of the embodiment of the portion of the vehicular sweeping machine shown in FIG. 3, with a portion of the frame and certain other components removed for clarity.
Figure 5:
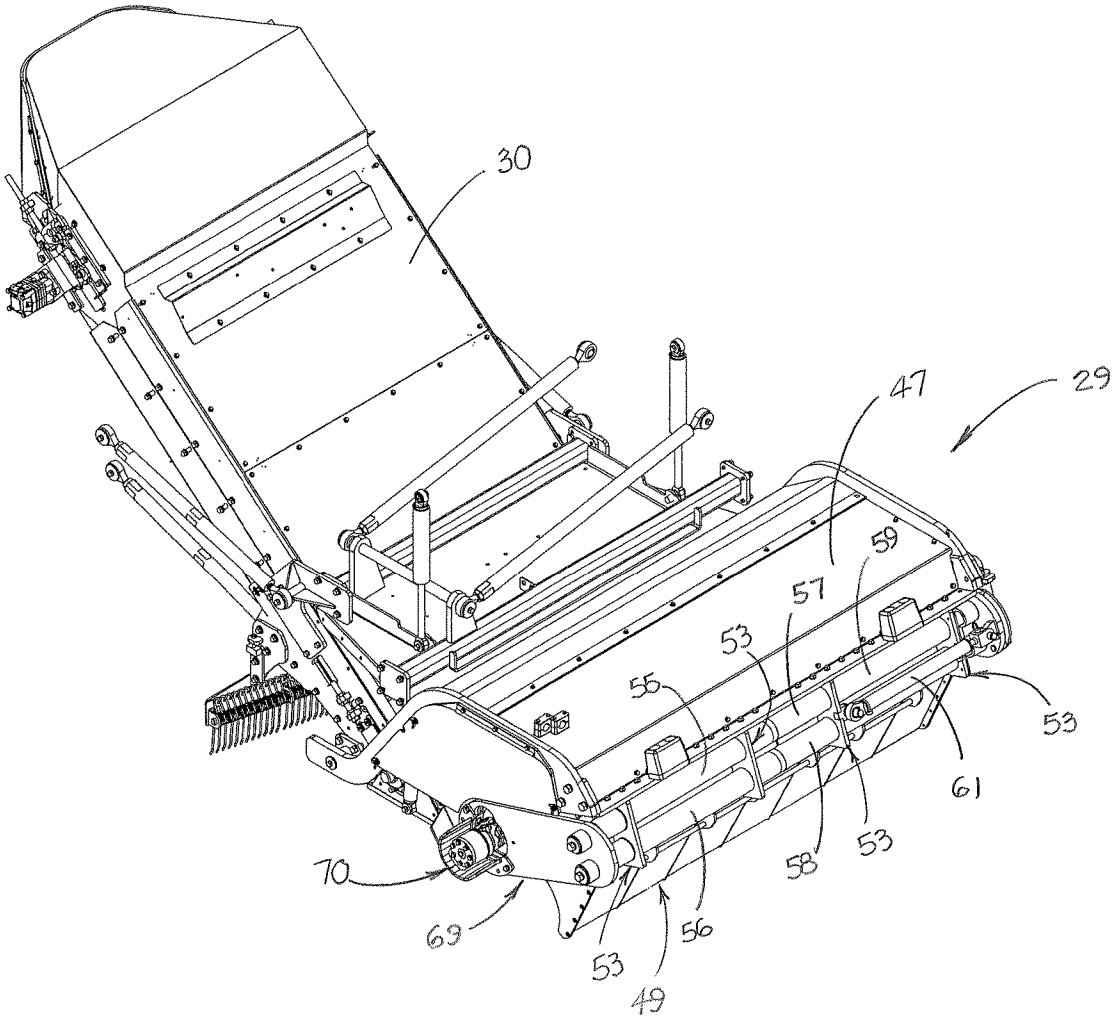
FIG. 5 is a perspective view of the broom conveyor and a portion of a broom assembly including a broom enclosure of a first width according to a preferred embodiment of the invention.
Figure 6:
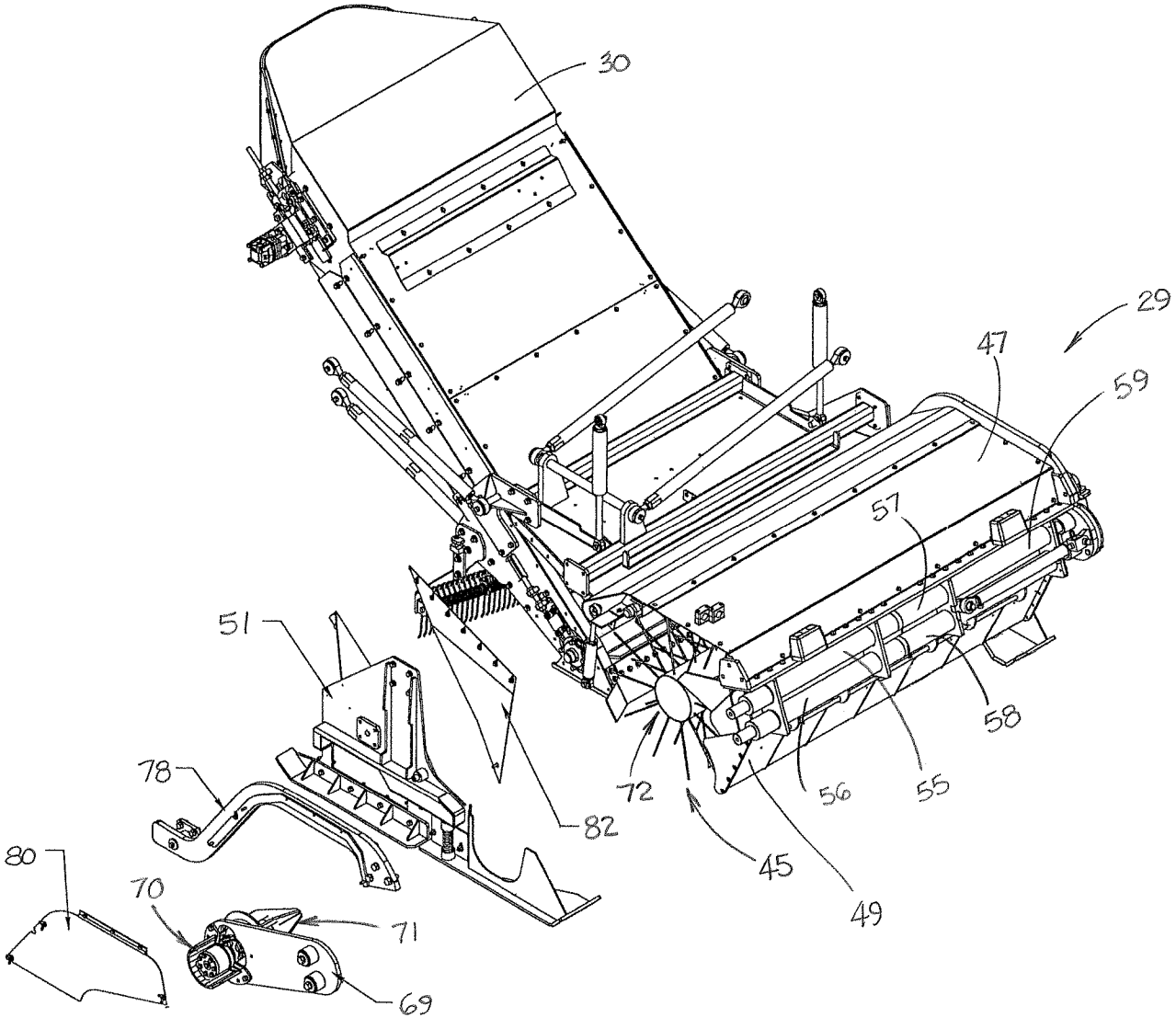
FIG. 6 is a first perspective view of the broom conveyor and a partially exploded view of the broom enclosure of the first width that is shown in FIG. 5.
Figure 7:
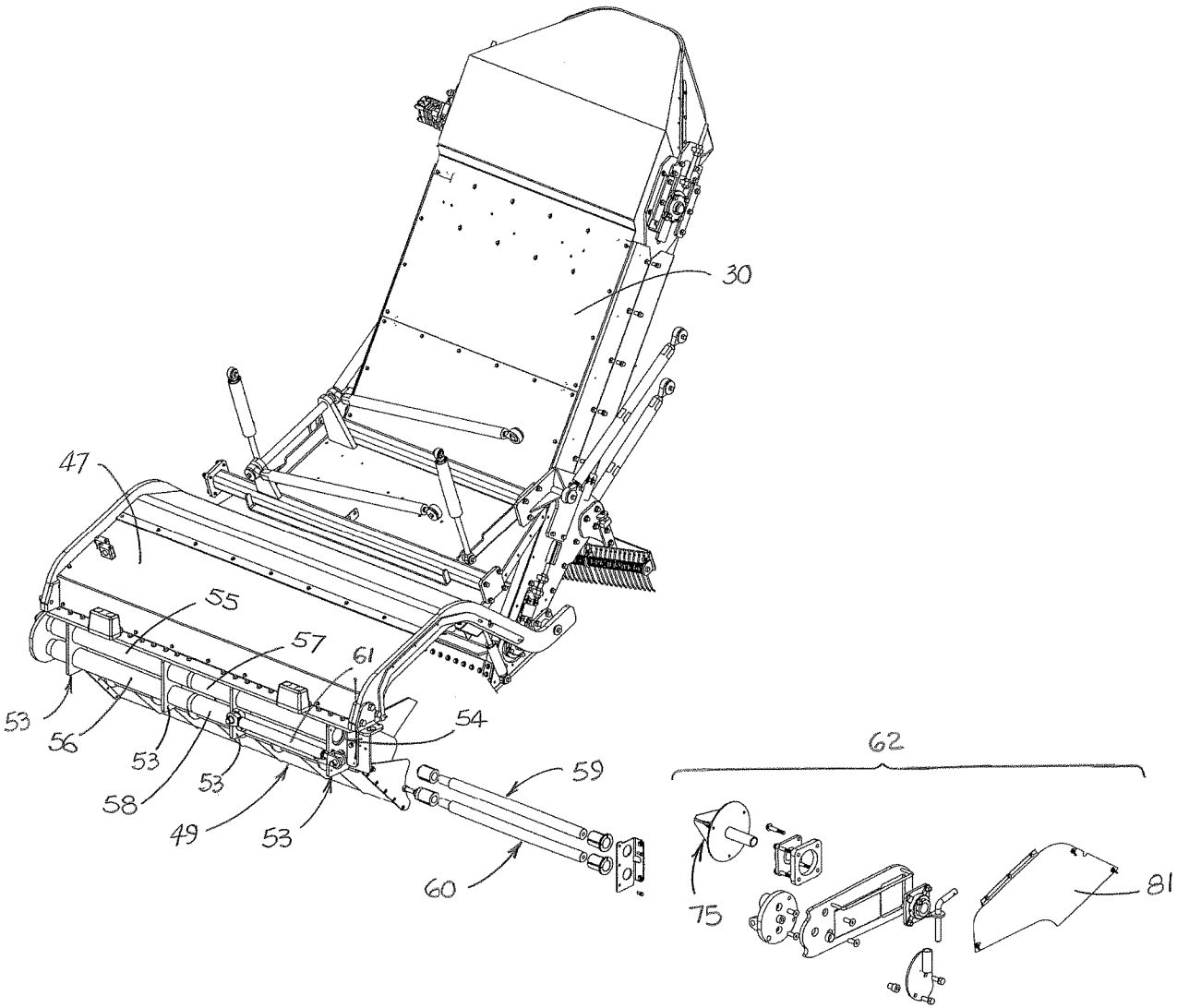
FIG. 7 is a second perspective view of the broom conveyor and a partially exploded view of the broom enclosure of the first width that is shown in FIG. 5.

This description of the preferred embodiment of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

As shown in FIGS. 1-4, vehicular sweeping machine 25 includes frame 26, engine compartment 27, operator's cab 28, broom assembly 29, broom conveyor 30 and articulating discharge conveyor 31. Contained within engine compartment 27 is an engine (not shown) that provides power for driving rear wheels 32 of the machine, as well as for operating the broom assembly and other components of the vehicular sweeping machine. Steering of machine 25 is accomplished by means of a conventional steering assembly operating through front wheels 34. When machine 25 is driven in forward sweeping direction "D", it is desirable that the bottom of broom assembly 29 sits down on the sweeping surface to create a stable seal against the roadway. Such stability is provided by mounting the broom assembly 29 on frame 26 by means of one or more linear actuators such as linear actuator 44, which is mounted with one end pivotally attached to the frame on one side of the machine and the other end pivotally attached to the broom assembly on the opposite side of the machine. In other embodiments of the invention (not shown), a plurality of linear actuators may be mounted generally vertically in pairs with one end attached to the frame and the other end attached to the broom assembly. In these embodiments, one front linear actuator and one rear linear actuator are mounted generally vertically on one side of the machine and one front linear actuator and one rear linear actuator are mounted generally vertically on the other side of the machine.

Figure 8:
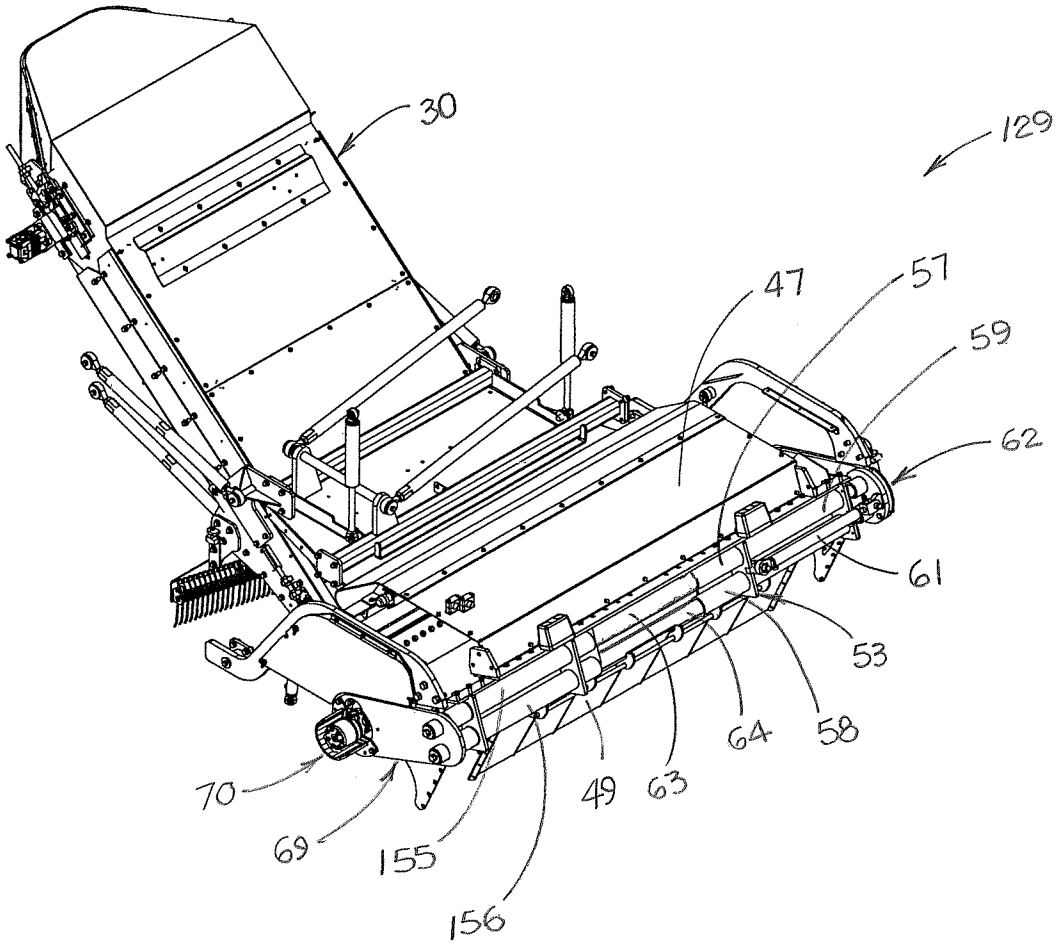
FIG. 8 is a perspective view of the broom conveyor and a partial broom enclosure of a second width that is larger than the first width according to a preferred embodiment of the invention.
Figure 9:
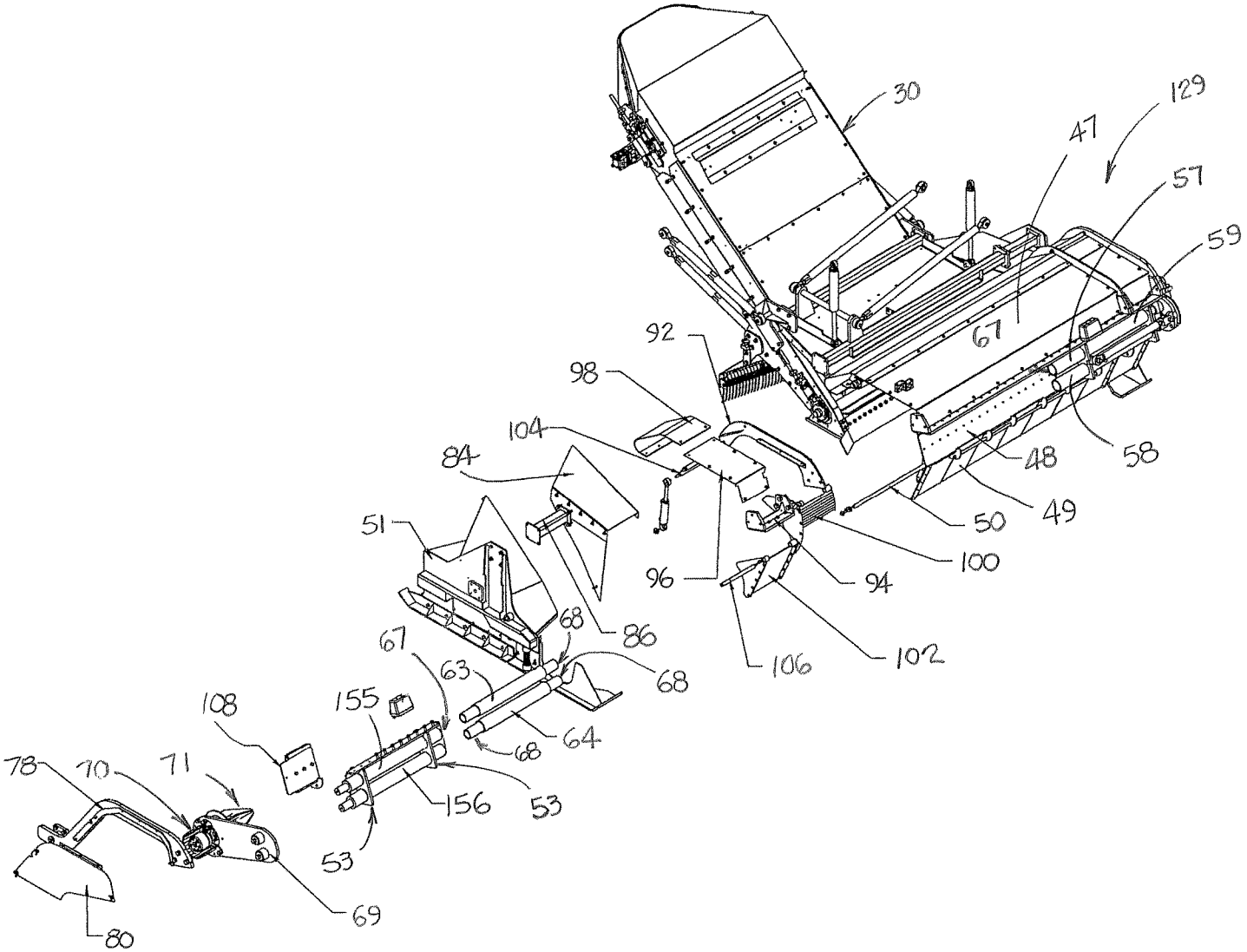
FIG. 9 is a perspective view of the broom conveyor and a partially exploded view of the broom enclosure shown in FIG. 8, showing the extension components necessary to complete this embodiment of the broom enclosure.

Broom assembly 29 is shown in FIGS. 1-7 and is adapted to accommodate broom 45 of a first length, such as for example six feet, whereas broom assembly 129, which is shown partially in FIG. 8 and in FIG. 9, is adapted to accommodate a broom (not shown) that is longer than broom 45, such as for example eight feet. Broom assembly 229, which is shown partially in FIG. 10 and in FIG. 11, is adapted to accommodate broom 46 of a third length that is longer than the broom of broom assembly 129, such as for example ten feet. Thus, broom assembly 29 is sized to accommodate broom 45 of a first length, which broom is also sized to sweep material from the roadway directly into broom conveyor 30 of a fixed width.

Each of the broom assemblies includes a primary broom enclosure, and broom assemblies 129 and 229 also include at least one broom enclosure extension assembly that may be removably attached to the primary broom enclosure of broom assembly 29. The extension assemblies include broom extension components that are adapted to be installed on the primary broom enclosure using simple hand tools to convert from broom assembly 29 to broom assembly 129 or broom assembly 229. These broom extension components are adapted to increase the width of the primary broom enclosure to accommodate a longer broom and to direct material swept by the longer broom into broom conveyor 30.

Obviously, the extension components can be removed from broom assemblies 129 and 229 to return the configuration of the broom assembly to that of broom assembly 29. In addition, the extension components of broom assembly 129 can be removed and replaced with the extension components of broom assembly 229. Similarly, the extension components of broom assembly 229 can be removed and replaced with the extension components of broom assembly 129. Other broom assemblies of longer or shorter length are also contemplated within the scope of the invention. Thus, for example, broom assembly 29 could be modified to extend its width on the left side or the right side, but not on both sides. The scope of the invention includes broom assemblies to accommodate brooms of six, seven, eight, nine, or ten feet in length, or even longer brooms that permit a sweeping width that is large enough to sweep in one pass the milled surface of a roadway that has been milled by a milling machine of the largest size.

Each broom assembly includes a primary broom enclosure comprising top plate 47 and upper panel 48 of an outer moldboard (best shown in FIGS. 9 and 11). Lower panel 49 of the outer moldboard is joined to upper panel 48 by hinge pin 50 (shown in FIG. 9). Preferably, upper panel 48 and lower panel 49 of the outer moldboard are of a generally rigid construction. It is also preferred that an inner curved moldboard (not shown) be attached at the top of upper panel 48 of the outer moldboard by a hinge (also not shown). The primary broom enclosure also includes a pair of end gates, including left end gate 51 (shown in FIGS. 2-4, 6 and 11) and right end gate 52 (shown in FIG. 1). The end gates are preferably mirror images of each other, and are removably attached on opposite sides of the broom enclosure. Mounted to the rear of upper panel 48 of the outer moldboard is a support tube assembly that is adapted to provide structural support for the broom assembly. In the preferred embodiment of the invention illustrated in the drawings, the support tube assembly includes a plurality of support tube brackets 53. Each support tube bracket includes a pair of holes such as hole 54 (shown in FIG. 7), each of which is adapted to receive a support tube. Thus, upper left support tube 55, lower left support tube 56, upper central support tube 57, lower central support tube 58, upper right support tube 59 and lower right support tube 60 (shown in FIG. 7) are mounted between, and through the holes in, adjacent pairs of support tube brackets 53. Each of the embodiments of the invention illustrated in the drawings includes an upper left support tube (either upper left support tube 55 or upper left support tube 155), a lower left support tube (either lower left support tube 56 or lower left support tube 156), upper central support tube 57, lower central support tube 58, upper right support tube 59 and lower right support tube 60.

Figure 10:
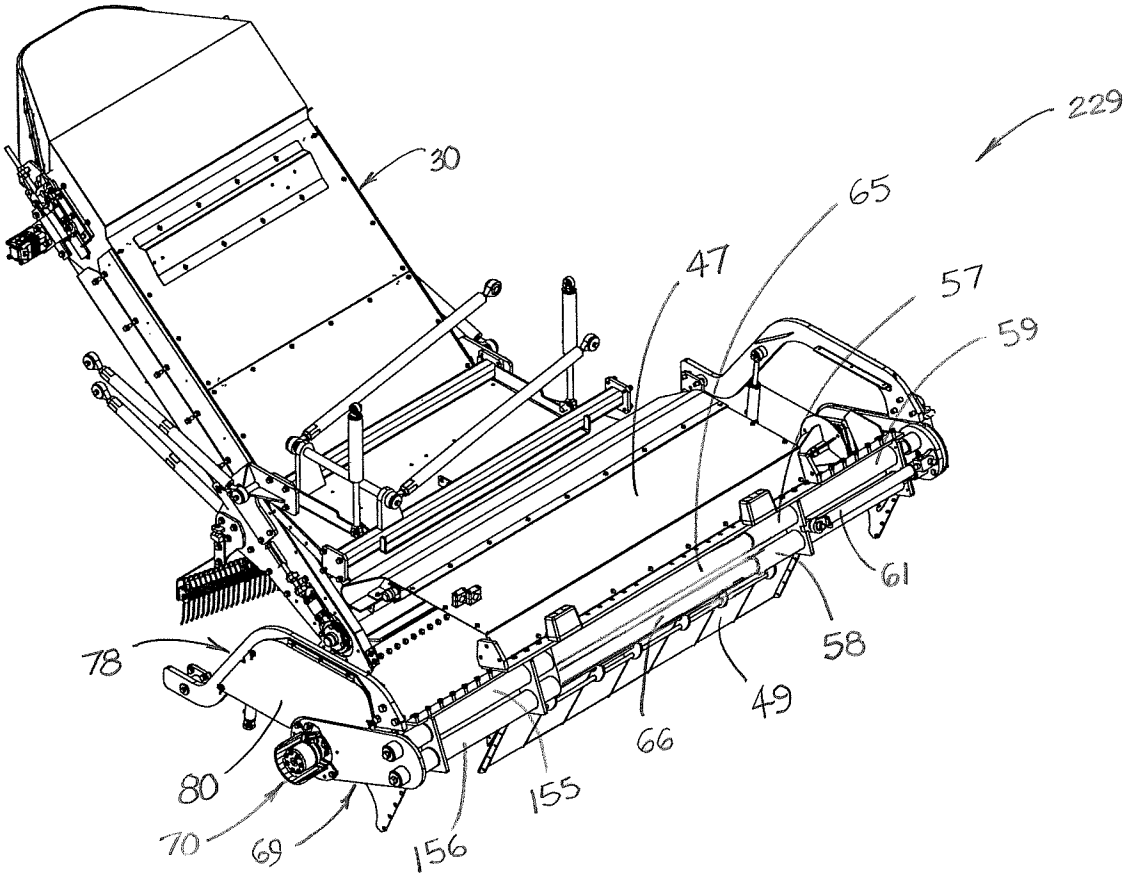
FIG. 10 is a perspective view of the broom conveyor and a partial broom enclosure of a third width that is larger than the second width according to a preferred embodiment of the invention.
Figure 11:
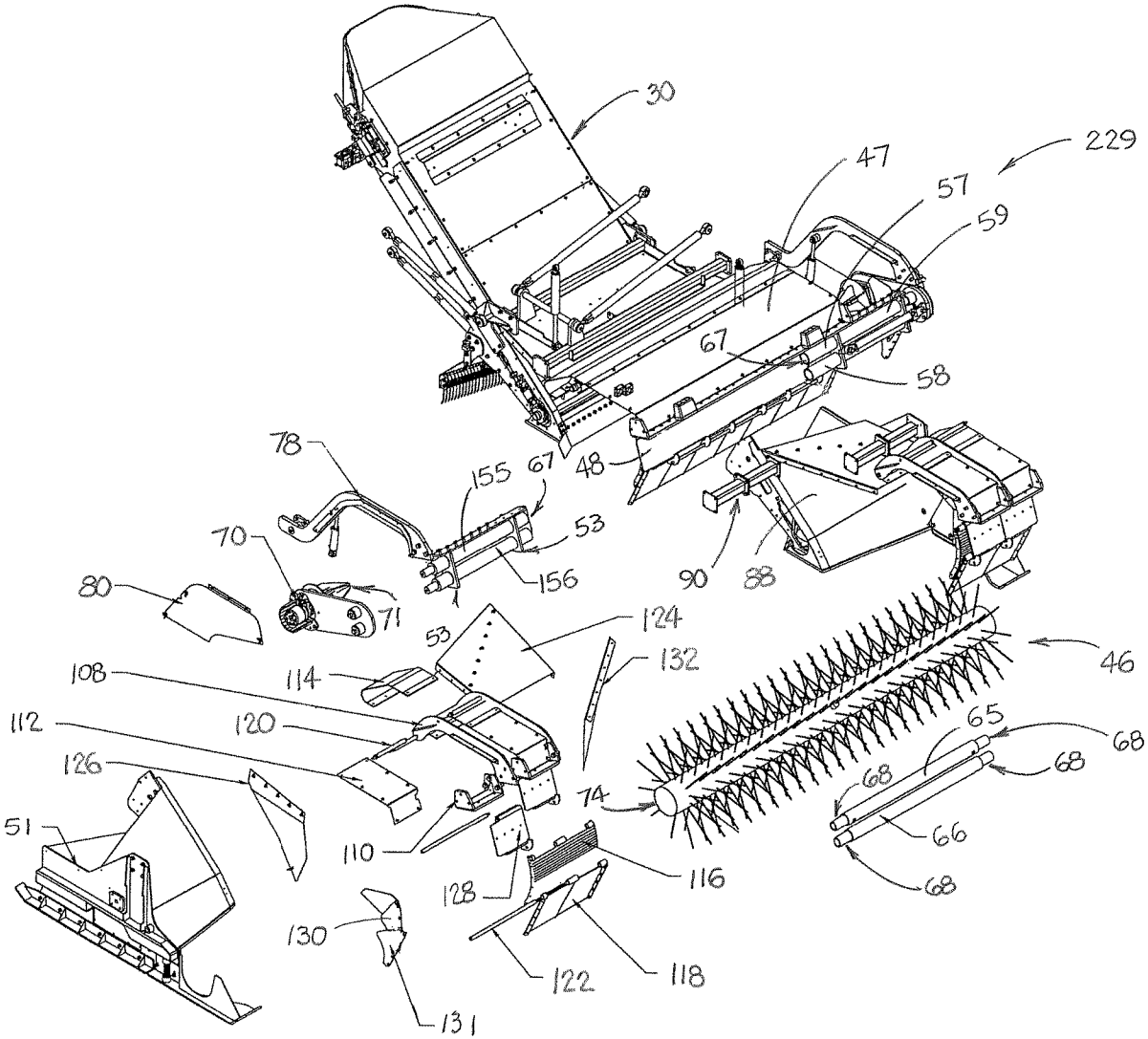
FIG. 11 is a perspective view of the broom conveyor and a partially exploded view of the broom enclosure shown in FIG. 10, showing the extension components necessary to complete this embodiment of the broom enclosure.

When it is desired to modify the width of a broom assembly such as broom assembly 29, linear actuator 61 of the support tube assembly, which is located behind lower right support tube 60, is extended to move right hub assembly 62 outwardly, thereby allowing an operator to move upper central support tube 57, lower central support tube 58, upper right support tube 59 and lower right support tube 60 to the right to permit the insertion in the support tube assembly of first upper extension support tube 63 and first lower extension support tube 64 of a first length, both of which are shown in FIGS. 8 and 9, or second upper extension support tube 65 and second lower extension support tube 66 of a second length, both of which are shown in FIGS. 10 and 11. In this embodiment of the invention, upper left support tube 55 (shown in FIGS. 5-7) is replaced by upper left extension support tube 155 of the same length (shown in FIGS. 8-11) and lower left support tube 56 is replaced by lower left extension support tube 156 of the same length.

In the embodiment of the invention illustrated in the drawings, upper central support tube 57 has a receiver end 67 that is adapted to receive an insertion end (not shown) of upper left support tube 55, or an insertion end 68 of first upper extension support tube 63 or an insertion end 68 of second upper extension support tube 65. Similarly, lower central support tube 58, which is essentially identical to upper central support tube 57, has a receiver end 67 that is adapted to receive an insertion end (not shown) of lower left support tube 56, or an insertion end 68 of first lower extension support tube 64 or an insertion end 68 of second lower extension support tube 66. In the same manner, upper left extension support tube 155 is adapted to replace upper left support tube 55 and has a receiver end 67 that is adapted to receive an insertion end 68 of first upper extension support tube 63 or an insertion end 68 of second upper extension support tube 65. Similarly, lower left extension support tube 156 is adapted to replace lower left support tube 56 and has a receiver end 67 that is adapted to receive an insertion end 68 of first lower extension support tube 64 or an insertion end 68 of second lower extension support tube 66. Preferably, the insertion ends of each of the support tubes are identical to each other, as are the receiver ends.

Mounted to upper left support tube 55 and lower left support tube 56 (or to upper left extension support tube 155 and lower left extension support tube 156) is drive motor assembly 69 having drive motor 70 and broom drive hub 71 that is adapted to engage one end of broom tube 72 of broom 45 in broom assembly 29, or one end of the broom tube of a broom of a second length (not shown) in broom assembly 129, or one end of broom tube 74 of broom 46 of a third length in broom assembly 229, or one end of the broom tubes of brooms of other convenient lengths. The other end of the applicable broom tube is engaged by idler hub 75 of right hub assembly 62 (shown in FIG. 7). Other components of a preferred embodiment of each configuration of the broom assembly include left end gate sweep control arm 78 and right end gate sweep control arm 79 (shown in FIG. 1), and left end cover door 80 and right end cover door 81 (shown in FIGS. 1 and 7).

Left end gate transition plate 82 is provided for broom assembly 29, and this component may be replaced by first left extension end gate transition plate 84 for broom assembly 129. First left extension end gate transition plate 84 includes left end gate sweep support extension 86 that attaches to left end gate 51 to provide for the additional width of broom assembly 129. In addition, second left extension end gate transition plate 88, which includes left end gate sweep support extension 90, may replace left end gate transition plate 82 or first left extension end gate transition plate 84 to accommodate the additional width of broom assembly 229. The invention also contemplates that a right end gate transition plate, which is a mirror image of left end gate transition plate 82, may be provided for broom assembly 29. Similarly, a right extension end gate transition plate that is a mirror image of left extension end gate transition plate 84 may be provided for broom assembly 129, and a right end gate and transition plate which is a mirror image of left end gate transition plate 88, may be provided for broom assembly 229. The extension end gate transition plates are configured to direct material swept by the longer brooms into broom conveyor 30, which is sized to accommodate broom 45 of broom assembly 29.

Broom assembly 129 also includes a left first extension assembly comprising sweep control arm support extension 92, first frame extension 94, first top extension cover 96, first front extension cover 98, first upper panel moldboard extension 100, first lower panel moldboard extension 102, first sweep control arm extension pin 104 and first hinge pin extension 106. Broom assembly 129 also includes a right first extension assembly comprising components that are mirror images of the components of the left first extension assembly described herein.

Broom assembly 229 also includes a left second extension assembly comprising sweep control arm support extension 108, second frame extension 110, second top extension cover 112, second front extension cover 114, second upper panel moldboard extension 116, second lower panel moldboard extension 118, second sweep control arm extension pin 120, second hinge pin extension 122, second top cover extension 124, second end gate transition plate 126, second extension base 128, second inner moldboard plate 130, second outer moldboard plate 131 and second extension guide transition 132. Broom assembly 129 also includes a right second extension assembly comprising components that are mirror images of the components of the left second extension assembly described herein.

Each of broom assembly 29, broom assembly 129 and broom assembly 229 includes broom enclosure components that serve to direct material to broom conveyor 30 and to prevent material from passing outside of the end gates of the broom enclosure. Thus, when machine 25 is driven in forward sweeping direction "D", or when a sweeping machine having a broom assembly 129 is driven in a forward sweeping direction, or when a sweeping machine having a broom assembly 229 is driven in a forward sweeping direction, milling chips, dust and other material on the roadway will enter the broom assembly from its front side. As the broom is rotated about a generally horizontal axis, each end gate transition plate assembly is configured and adapted to funnel material towards the lower end of broom conveyor 30 for transport to discharge conveyor 31. The invention thus provides a broom assembly that can be readily modified to accommodate brooms of different lengths with common tools and in a short period of time.

Although this description contains many specifics, these should not be construed as limiting the scope of the invention but as merely providing an illustration of the presently preferred embodiments thereof, as well as the best mode contemplated by the inventors of carrying out the invention. The invention, as described and claimed herein, is susceptible to various modifications and adaptations as would be appreciated by those having ordinary skill in the art to which the invention relates.

What is claimed is:

1. A modular broom assembly for a vehicular sweeping machine that is adapted to rotate a broom about a substantially horizontal axis to sweep material into a broom conveyor of fixed width, said modular broom assembly being adapted to accommodate a broom of a first length and a broom of a second length that is longer than the first length, said modular broom assembly further comprising:

(a) a primary broom enclosure that is adapted to accommodate the broom of the first length;

(b) an extension assembly that includes broom extension components that are adapted to be installed on the primary broom enclosure:

(i) to increase the width of the primary broom enclosure to accommodate the broom of the second length; and (ii) to direct material swept by the broom of the second length into the broom conveyor.

2. The modular broom assembly of claim 1 wherein the extension assembly comprises:

(a) a left side extension assembly that includes broom extension components that are:

(i) adapted to be installed on the left side of the primary broom enclosure;

(ii) configured to direct material swept by the broom of the second length into the broom conveyor;

(b) a right side extension assembly that includes broom extension components that are:

(i) adapted to be installed on the right side of the primary broom enclosure;

(ii) configured to direct material swept by the broom of the second length into the broom conveyor.

3. The modular broom assembly of claim 1 wherein the primary broom enclosure comprises:

(a) a top plate;

(b) an upper panel of an outer moldboard;

(c) a left end gate;

(d) a right end gate.

4. The modular broom assembly of claim 3 wherein the primary broom enclosure includes a lower panel of the outer moldboard that is joined to the upper panel of the outer moldboard by a hinge pin.

5. The modular broom assembly of claim 3 wherein the broom enclosure extension assembly comprises an extension end gate transition plate that is:

(a) adapted to be mounted to the primary broom enclosure adjacent to the left end gate or the right end gate;

(b) configured to direct material swept by the broom of the second length into the broom conveyor.

6. The modular broom assembly of claim 3, which includes:

(a) a support tube assembly that is attached to the upper panel of the outer moldboard in order to provide structural support, said support tube assembly comprising:

(i) a left support tube;

(ii) a right support tube;

(iii) a central support tube;

(b) a extension support tube that can be removably inserted into the support tube assembly when it is desired to increase the width of the primary broom enclosure to accommodate the broom of the second length.

7. The modular broom assembly of claim 6:

(a) which includes a hub assembly on one side of the primary broom enclosure that is adapted to engage an end of a broom tube;

(b) wherein the support tube assembly includes a linear actuator that may be extended to move the hub assembly outwardly, thereby allowing an operator to move the central support tube to permit the insertion in the support tube assembly of the extension support tube.

8. The modular broom assembly of claim 6 wherein the support tube assembly includes a plurality of support tube brackets, each of which includes a hole that is adapted to receive a support tube.

9. The modular broom assembly of claim 3, which includes:

(a) a support tube assembly that is attached to the upper panel of the outer moldboard in order to provide structural support, said support tube assembly comprising:

(i) an upper left support tube;

(ii) a lower left support tube;

(iii) an upper right support tube;

(iv) a lower right support tube;

(v) an upper central support tube;

(vi) a lower central support tube;

(b) an upper extension support tube that can be removably inserted into the support tube assembly when it is desired to increase the width of the primary broom enclosure to accommodate the broom of the second length;

(c) a lower extension support tube that can be removably inserted into the support tube assembly when it is desired to increase the width of the primary broom enclosure to accommodate the broom of the second length.

10. A modular broom assembly for a vehicular sweeping machine that is adapted to rotate a broom about a substantially horizontal axis to sweep material into a broom conveyor of fixed width, said modular broom assembly being adapted to accommodate a broom of a first length and a plurality of brooms of different lengths, each of which plurality of brooms is longer than the first length, said modular broom assembly further comprising:

(a) a primary broom enclosure that is adapted to accommodate the broom of the first length, said primary broom enclosure including:
  (i) a top plate;
  (ii) an upper panel of an outer moldboard;
  (iii) a left end gate;
  (iv) a right end gate;

(b) an extension assembly for each of the plurality of brooms of different lengths, each of which includes broom extension components that are adapted to be installed on the primary broom enclosure:
  (i) to increase the width of the primary broom enclosure to accommodate one of the plurality of brooms of different lengths; and
  (ii) to direct material swept by the one of the plurality of brooms of different lengths into the broom conveyor.

11. The modular broom assembly of claim 10, which includes:

(a) a support tube assembly that is attached to the upper panel of the outer moldboard in order to provide structural support, said support tube assembly comprising:
  (i) a left support tube;
  (ii) a right support tube;
  (iii) a central support tube;

(b) a extension support tube for each of the extension assemblies, each of which can be removably inserted into the support tube assembly when it is desired to increase the width of the primary broom enclosure to accommodate one of the plurality of brooms of different lengths.

12. The modular broom assembly of claim 10 wherein each broom enclosure extension assembly comprises:

(a) a left side extension assembly that includes broom extension components that are:
  (i) adapted to be installed on the left side of the primary broom enclosure;
  (ii) configured to direct material swept by one of the plurality of brooms of different lengths into the broom conveyor;

(b) a right side extension assembly that includes broom extension components that are:
  (i) adapted to be installed on the right side of the primary broom enclosure;
  (ii) configured to direct material swept by one of the plurality of brooms of different lengths into the broom conveyor.

13. The modular broom assembly of claim 12 wherein:

(a) the left side extension assembly of each broom enclosure extension assembly includes a left extension end gate transition plate that is adapted to be mounted to the primary broom enclosure adjacent to the left end gate;

(b) the right side extension assembly of each broom enclosure extension assembly includes a right extension end gate transition plate that is adapted to be mounted to the primary broom enclosure adjacent to the right end gate.

* * * * *